US009617122B2

(12) United States Patent
Matheisl et al.

(10) Patent No.: US 9,617,122 B2
(45) Date of Patent: Apr. 11, 2017

(54) PALLET FOR A MOVING WALK OR STEP FOR AN ESCALATOR

(71) Applicant: Inventio AG, Hergiswil (CH)

(72) Inventors: Michael Matheisl, Vösendorf (AT); Robert Schulz, Vienna (AT); Thomas Illedits, Neufeld (AT); Werner Eidler, Göllersdorf (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 15/114,888

(22) PCT Filed: Dec. 4, 2014

(86) PCT No.: PCT/EP2014/076549
§ 371 (c)(1),
(2) Date: Jul. 28, 2016

(87) PCT Pub. No.: WO2015/113680
PCT Pub. Date: Aug. 6, 2015

(65) Prior Publication Data

US 2016/0355379 A1 Dec. 8, 2016

(30) Foreign Application Priority Data

Jan. 28, 2014 (EP) ..... 14152921

(51) Int. Cl.
*B66B 23/12* (2006.01)
*B66B 23/10* (2006.01)
(Continued)

(52) U.S. Cl.
CPC ..... *B66B 23/12* (2013.01); *B66B 21/02* (2013.01); *B66B 21/10* (2013.01); *B66B 23/10* (2013.01)

(58) Field of Classification Search
CPC ..... B66B 23/12; B66B 23/10
See application file for complete search history.

(56) References Cited

U.S. PATENT DOCUMENTS 4,805,763 A * 2/1989 Kitamura ..... B66B 23/12 198/332
5,337,879 A * 8/1994 Fischer ..... B66B 23/12 198/333

(Continued)

FOREIGN PATENT DOCUMENTS

EP 1057773 A2 12/2000
EP 2017216 A1 1/2009

(Continued)

*Primary Examiner* — Thomas Randazzo
(74) *Attorney, Agent, or Firm* — Fraser Clemens Martin & Miller LLC; William J. Clemens

(57) ABSTRACT

A step of an escalator or a pallet of a moving walk has a supporting body with a base and at least one tread-element with a tread-surface wherein, on an underside that faces away from the tread-surface, the at-least one tread-element has at least one fastening protrusion. In the assembled state, the at-least one fastening protrusion protrudes through an opening in the base. Arranged on the side of the base that faces away from the tread-element, at least partly between the base and the fastening protrusion, is at least one fixing element. The fixing element fixes the tread-element against the base in a pretensioned manner.

17 Claims, 3 Drawing Sheets

(51) Int. Cl.
*B66B 21/10* (2006.01)
*B66B 21/02* (2006.01)

(56) References Cited

U.S. PATENT DOCUMENTS

| | | | | |
|---|---|---|---|---|
| 5,439,090 | A * | 8/1995 | Findlay | B66B 23/12 198/333 |
| 6,398,003 | B1 * | 6/2002 | Jasinetzky | B66B 23/12 198/333 |
| 7,407,049 | B2 * | 8/2008 | Aulanko | B66B 23/12 198/333 |
| 8,240,452 | B2 * | 8/2012 | Fischer | B66B 23/12 198/333 |

FOREIGN PATENT DOCUMENTS

| | | | |
|---|---|---|---|
| EP | 1755999 | B1 | 9/2009 |
| JP | H0616374 | A | 1/1994 |
| JP | 2001316064 | A | 11/2001 |

* cited by examiner

PALLET FOR A MOVING WALK OR STEP FOR AN ESCALATOR

FIELD

The invention relates to a step for an escalator or a pallet for a moving walk, which step or pallet contains a supporting body and a tread-element.

BACKGROUND

Passenger transportation devices such as escalators and moving walks are generally-known and efficient devices for the transportation of people. Escalators are typically used to transport people in the vertical direction, for example from one story of a building to another story, while moving walks are mostly used for the transportation of people in the horizontal direction, or with a slight incline of up to 12°, from one point to another point. The length and the width of the passenger transportation device are chosen depending on the expected passenger traffic in the respective application.

Escalator steps and pallets are designed as monolithic or multi-part components and normally manufactured by a casting, extrusion, or forging method. The upper side of the tread-elements of steps and pallets has a tread pattern in the form of a sequence of parallel ribs or ridges that run from the front-side to the back-side of the tread-element. Hence, the ribs extend in the foreseen direction of movement of the step or pallet. In the case of escalator steps, also their riser elements have ribs, which normally adjoin the ribs of the tread-elements. Further, the ribs are dimensioned to engage with the comb-structures that are arranged in the boarding areas of the escalator or moving walk.

By means of at least one traction means, a plurality of steps is combined into a step-band of an escalator. In the same manner, a plurality of pallets is combined into a pallet-band. A moving walk or an escalator normally has a frame, or truss, with two reversing zones, between which the pallet-band or the step-band respectively is guided in circulating manner.

If the pallets or steps are manufactured in one piece from cast or die-cast aluminum, or from another suitable metal or a metal alloy, an extensive set of molds, jigs, and tools must be available, since each width of the pallet-band or of the step-band requires its own mold. The molds for pallets and steps are, however, very expensive. Further, the size of these molded parts, in particular the tread-element with its ribs, can result in casting problems, namely that of cavity formation, to avoid which an elaborate tempering of the molds is necessary.

To solve this problem, EP 1 755 999 B1 proposes a modular construction of pallets, so that the various widths of the pallets can be manufactured with fewer, and smaller, molds. The pallets consist essentially of a die-cast supporting body of aluminum and of a plurality of tread-elements. The tread-elements are fastened to the supporting body by means of fastening protrusions, which protrude into the supporting body, and a locking element. A first disadvantage of this solution is that, despite the spring elements that are arranged between the tread-elements and the supporting body, through vibrations and shocks which inevitably occur during operation, unpleasant noises can occur as a consequence of relative movements between the tread-elements and the supporting body when the vibrations are in the range of the resonant frequency of this vibration system of spring element and tread-elements. Further, after a certain period of use, the spring element can display symptoms of subsidence, since it is stressed by the users each time they board. The damping element, which is proposed as alternative to the spring element and arranged between the tread-plates and the supporting body, also has disadvantages. As a consequence of the repeated loading of the tread-plates by users, and the vibrations that are present, these damping elements of plastic can be rubbed between the tread-plate and the supporting body. In addition, lubricants that are present in escalators and moving walks, which are particularly used in the area of the pallet-band or step-band, can also decompose these plastic damping elements.

Further, in the presence of a spring element or damping element, the mounting of the tread-elements on the supporting body is quite elaborate, since, in the case of a multi-part tread-element, all tread-elements must be pressed against the supporting body simultaneously, in order that a lateral insertion of the bolt, or a turning of the excenter, is at all possible.

SUMMARY

The task of the present invention is therefore to create a step, or pallet, with a supporting body and with a tread-element, which is simple and inexpensive to manufacture, which is quick and easy to assemble, and which, despite its simple construction, enables a quiet running of the step-band, or of the pallet-band, respectively.

This task is solved by a step of an escalator, or a pallet of a moving walk, which has a supporting body with a base, at least one fixing element, and at least one tread-element with a tread-surface. On a lower side which faces away from the tread-element, the at-least one tread-element has at least one fastening protrusion. In the assembled state, the at-least one fastening protrusion protrudes through an opening which is embodied in the base and assigned to this fastening protrusion. In addition, the fastening protrusion has at least one slot, which extends parallel to the tread-surface, and in which slot the fixing element is at least partly insertable, so that, in the assembled state, the fixing element is arranged at least partly between the base and the fastening protrusion and the tread-element is fixed by the fixing element against the base in pretensioned manner.

On account of this design, the tread-element is fixed against the base in its loading direction (direction of the weight-force of a user) in pretensioned manner, as a result of which no elastic intermediate layer is proposed between the base of the supporting body and the tread-element, as is proposed, for example, in EP 1 755 999 B1. The lack of an elastic intermediate layer decisively increases the operating safety of the pallet or step, since an elastic intermediate layer carries with it the danger of symptoms of subsidence or decomposition, which could result in loose tread-elements. Further, loose tread plates can destroy the comb structures which are arranged in the boarding areas of the escalator or of the moving walk. On account of the insertable fixing element, also no vertical screw-fastenings for fixing the tread-elements are necessary, whose pretensioning on boarding of the tread-element is relieved and which, in the event of excessively large loss of pretension force, can become loose.

The fastening protrusion can have, for example, a conical, truncated conical, cylindrical, or cuboid basic shape.

The supporting body can have an extrusion-molded tube or section, a formed part of cut-and-bent plate, or a step-skeleton or pallet-skeleton which is assembled from a plurality of parts.

In order to facilitate the mounting of the tread-element on the supporting body, the at-least one fastening protrusion preferably extends perpendicular to the tread-surface. Preferably, provided on the tread-element is a plurality of fastening protrusions, which are distributed over the planar extent of the former. Ideally, there is a fastening protrusion arranged at at-least each corner of the tread-element.

The step, or pallet, can be assembled in such manner that the tread-element can first be laid on the base of the supporting body so that the fastening protrusion of the former protrudes through the assigned opening. Subsequently, the fixing element can be arranged on the side of the base that faces away from the tread-element and can be inserted, or driven, into the slot of the fastening protrusion, so that, in the assembled state, the fixing element is at least partly arranged between the base and the fastening protrusion.

In order to assure a construction of the step, or pallet, that is as simple as possible, the planar extent of the tread-element is preferably bounded by at least two parallel end-faces which extend in the foreseen direction of movement of the step or pallet and at least two side-edges which are arranged perpendicular to the end-faces, which extend in the direction of the width of the step or pallet.

Further, the tread-element, which, on account of its ribs or ridges is difficult to manufacture, can have a width which corresponds to only a part of the width of the step or pallet, so that, in order to obtain a seamless tread-surface over the entire width of the step or pallet, the supporting body must be provided with a plurality of tread-elements. Such tread-elements of lesser width can, for example, be manufactured by means of smaller die-casting machines which operate at a higher cycle-frequency. Through the division into smaller tread-elements, all common step-widths, or pallet-widths, can be manufactured with the use of the same tread-element size or tread-element dimension. The narrowest pallet or step has, for example, a tread-element which is secured to the supporting body by means of a fixing element. A step or pallet with a greater width can then, for example, have a plurality of identically-shaped tread-elements, which, for example, are fixed by means of a common fixing element to the supporting body in pretensioned manner.

The separation into a supporting body and into one or more tread-elements has not only manufacturing-related advantages. Through the separation, different materials can be used which optimally complement each other. For example, a supporting body of steel has a substantially higher strength under pulsating and alternating stresses than a comparable supporting body of aluminum. In particular, for greater transportation widths, or pallet-widths or step-widths above 1100 mm, an aluminum supporting body with compact cross-sections can hardly be used anymore, because its lifetime would be too short on account of the oscillating alternating loads.

The side of the base that faces away from the step-element can also serve as assembly aid, if the fixing element that is adjacently parallel to the base of this side is displaceable.

A particularly time-saving and efficient assembly of the step, or pallet, can be achieved if all fastening protrusions of all the tread-elements that are arranged on the base of a supporting body can be fixed through a common fixing element to the supporting body pretensioned against the base.

In order to generate a pretension, provided on the fastening protrusion or on the supporting body can be contours which the fixing element must pass when being pushed in. These contours could bring about a lifting of the fixing element from the facing-away side of the base if they are embodied in, for example, the form of a ramp. It is, however, particularly advantageous if, for the purpose of generating a pretension force, the fixing element has at least one wedge-tongue, since the fixing element can be, for example, manufactured as a sheet-metal part and a wedge-tongue is very easily formable on this sheet-metal part. Through the wedge-shaped embodiment of the wedge-tongue, which is driven or hammered between a projecting contour of the fastening protrusion and the facing-away side of the base, a pretension force can be generated which depends on the wedge-angle of the wedge-tongue. A loss of the pretension force is not to be expected, if the wedge-angle of the wedge-tongue can be kept so small that, as a result of the friction forces, a self-securing is present. Despite shocks and vibrations or oscillations that occur in operation, through the pretension of the tread-element against the base of the supporting body, the former is permanently and securely fastened to the supporting body.

In addition, a particular advantage of the fastening according to the invention by means of fixing element is that a faulty assembly is immediately detectable since, in the event of an unassembled or faultily assembled fixing element, the tread-element or, if the step or pallet has a plurality of tread-elements, one or more tread-elements, drop(s) down from a reversed supporting body even before the passenger transportation device is put into operation. If the fixing element was only inserted, but not driven in, the steps or pallets rattle and the fixing element visibly protrudes therefrom. Self-evidently, by means of a monitoring sensor which is arranged in the escalator or in the moving walk, a correct seating of the at-least one fixing element of a step or pallet can be monitored, in that the position of one of its ends is, for example, optically or mechanically scanned. The number of the monitoring sensors is according to the number of lines of fixing elements per step of a step-band or per pallet of a pallet-band. Also colored markings on the tread-elements can be used for checking the correct mounting.

The at-least one wedge-tongue can further be embodied in elastic or sprung manner. The elastic wedge-tongue has the advantage that manufacturing-related tolerances between the fastening protrusion and the base do not result in varying end-positions of the fixing element in the mounted state. Specifically, if the fixing element has a rigid wedge-tongue, this can only be driven between the fastening protrusion and the base to the extent that the distance that is present between a fitting contour, or nose, of the fastening protrusion and the base permits. Through the elastic wedge-tongue, the fixing element can in each case adapt to the distance that is present and fix the tread-element to the supporting body in pretensioned manner.

As securing element, embodied on the fixing element can be at least one catch. After the insertion of the fixing element, the latter can engage in the base or on the fastening protrusion. The catch subsequently rests mechanically engaged against the fastening protrusion or against a suitable contour of the base and thereby permanently holds the fixing element in position. The catch can also be embodied on at least one elastic wedge-tongue. Self-evidently, catches can be embodied on all elastic wedge-tongues, although in the embodiment of the elastic wedge-tongues attention must be paid to a sufficiently residual pretension force of the latter in the assembled state.

In order to prevent displacements of the tread-element relative to the supporting body also in a plane that contains the base, at least one positioning element can be embodied on the tread-element which, with placed-on tread-element, protrudes into an accurately fitting positioning opening of the base. Preferably, the positioning element is embodied in the form of a truncated cone and the accurately-fitting positioning opening as a cylindrical borehole, so that, upon a laying-on of the tread-element onto the base, the conical surface of the positioning element is slightly deformed by the positioning opening and adapts itself to the latter.

In addition to the openings for the fastening protrusions, in order to reduce the weight of the pallet or step, the base can also have apertures. Further, through the application of an adhesive, for example in the area of these apertures and openings, a vibration- and/or sound-damping, and a particularly rigid fastening of the tread-element on the supporting body, can be achieved. Particularly suitable are pasty or liquid single-component adhesive/sealing compounds based on silane-modified polymers which, through air humidity, cross-link into an elastic product. These are used, for example in autobody and vehicle construction, wagon and container construction, as well as in metal and apparatus construction. All of these solutions have the advantage that they can reduce, or prevent, the formation of contact corrosion between the supporting body and the tread-element if the material of the tread element differs from the material of the supporting body.

A step or pallet must have a certain stability of form when it is loaded with the foreseen operating load or payload. Further, the laterally-extending cross-section of the pallet or step is bounded by adjacent steps or pallets and available spaces in the reversing zones. If the supporting body of the step or pallet is embodied in the form of a tube, and has a triangular or trapezoidal cross-section, it can be reversed without problem in the reversing zones and has a high modulus of resistance with regard to bending and twisting moments.

A plurality of the pallets described above is arranged on at least one traction means, whereby a pallet-band for a moving walk can be created. In identical manner, a step-band of an escalator is also created, wherein instead of pallets, a plurality of steps is arranged on at least one traction means. Normally, however, two traction means are used for one pallet-band or step-band, the pallets or steps being arranged between the traction means. As traction means, sprocket chains, ropes, or belts, for example, can be used. Further, arranged on the supporting body or on the traction means can be low-friction guide-elements such as rollers or sliding elements.

Self-evidently, the invention can be used not only in new escalators or moving walks. For example, an existing moving walk can be modernized by replacing the existing pallet-band by a pallet-band according to the invention, or an escalator by replacing the existing step-band by a step-band according to the invention.

DESCRIPTION OF THE DRAWINGS

The at-least one tread-element, and its assembly on a supporting body of a step or pallet by means of at least one fixing element, are expounded in greater detail below in relation to examples and by reference to the drawings. Shown are in.

DETAILED DESCRIPTION

Figure 1:
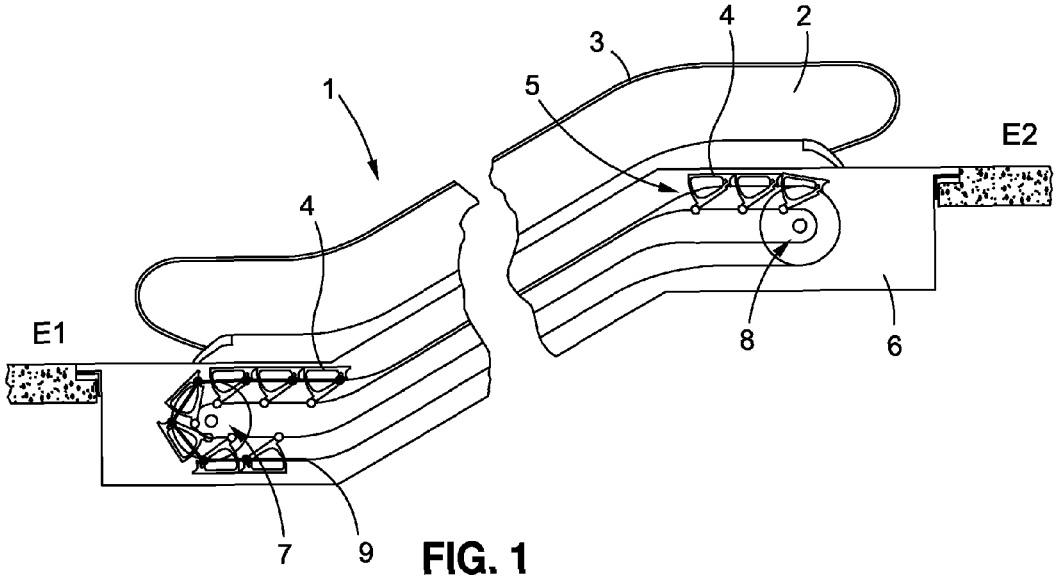
FIG. 1: in diagrammatic depiction, an escalator with a frame or a truss and two reversing zones, wherein, arranged in the truss, are guiderails, and between the reversing zones, a circulating step-band.

FIG. 1 shows diagrammatically in the side view an escalator 1, which joins a first story E1 with a second story E2. The escalator 1 has a frame 6, or truss 6, with two reversing zones 7, 8, between which a step-band 5 is guided in circulating manner. The step-band has traction means 9 on which steps 4 are arranged. Arranged on a balustrade 2 is a handrail 3. At its lower extremity, by means of a balustrade skirt, the balustrade 2 is connected with the truss 6.

Figure 2:
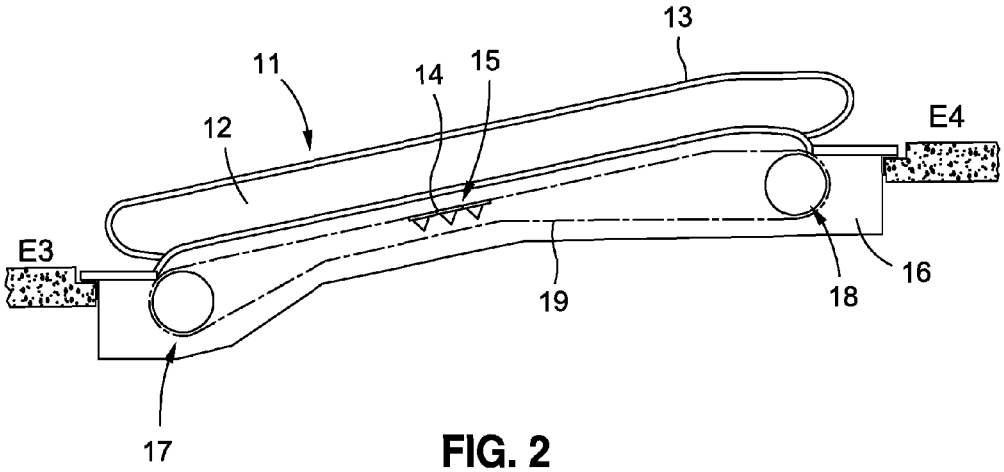
FIG. 2: in diagrammatic depiction, a moving walk with a frame and two reversing zones, wherein, arranged in the frame are guiderails and, between the reversing zones, a circulating pallet-band.

FIG. 2 shows diagrammatically in the side view a moving walk 11 constructed in similar manner, which also has a balustrade 12 with balustrade skirt and a handrail 13, a truss 16, and two reversing zones 17, 18. Different from the escalator 1 of FIG. 1, arranged between the reversing zones 17, 18, of the moving walk 11 in circulating manner is not a step-band but a pallet-band 15. The pallet-band 15 has traction means 19 on which the pallets 14 are arranged. The moving walk 11, for example, connects a third story E3 with a fourth story E4.

Figures 3, 4:
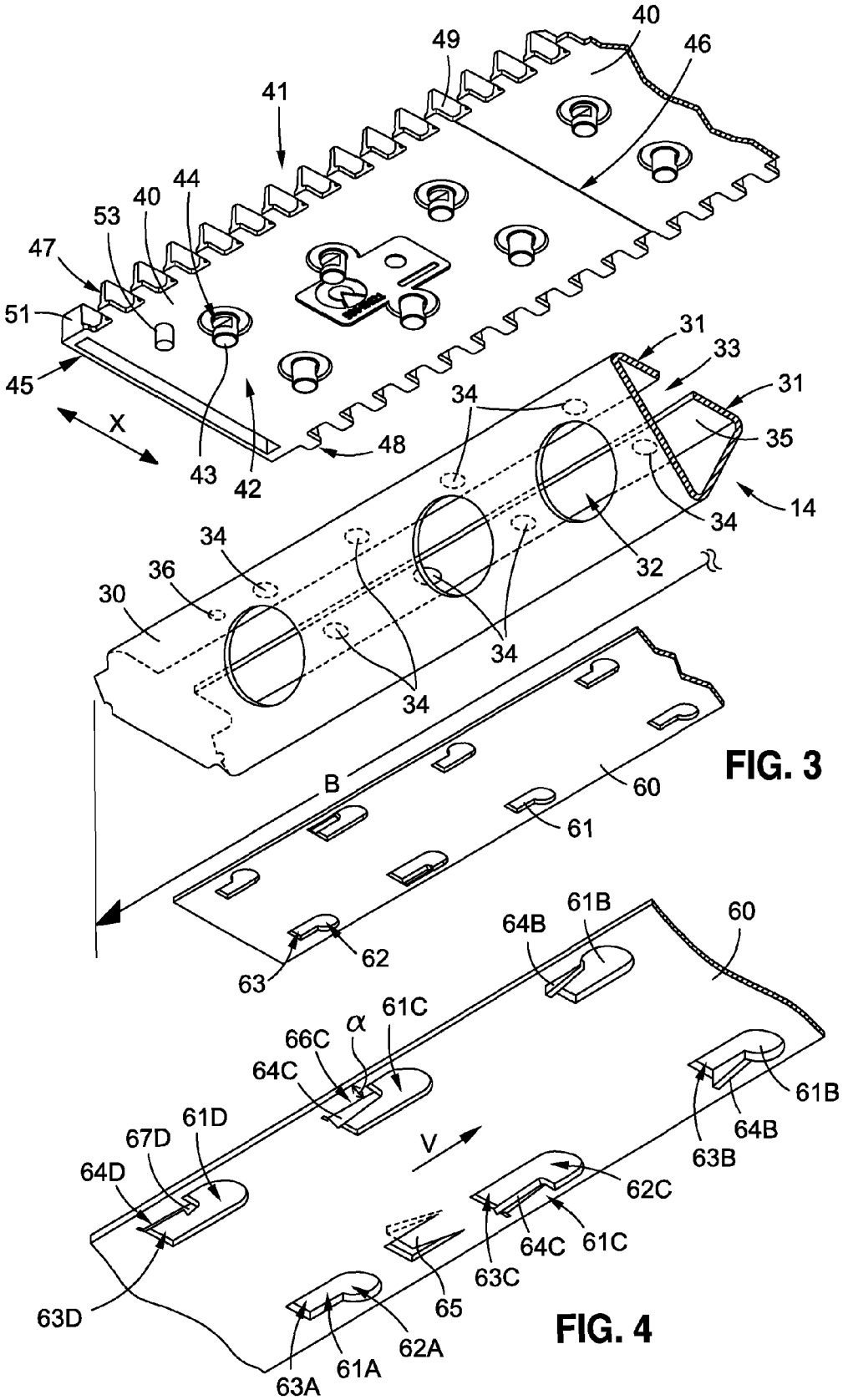
FIG. 3: an exploded-view drawing of a pallet-section, wherein two tread-elements, a supporting body and a fixing element are depicted.
FIG. 4: in three-dimensional depiction, a section of a fixing element with a plurality of possible embodiments of assembly openings.
Figure 5:
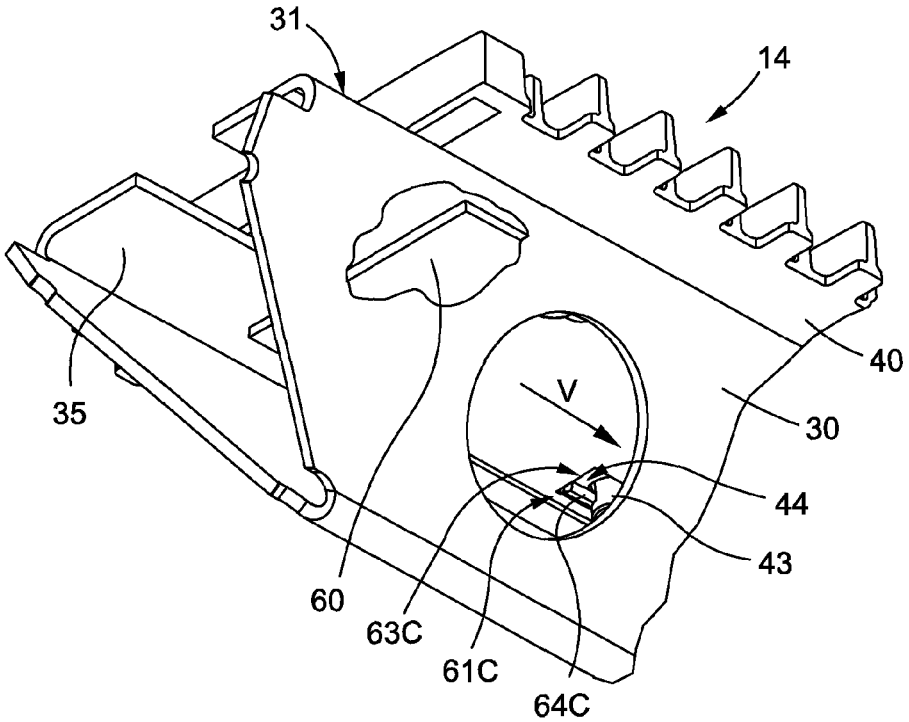
FIG. 5: a three-dimensional depiction of a partial underside view of the pallet depicted in FIG. 3.

FIGS. 3 to 5 are described jointly below, since in these figures the same pallet 14, or parts of this pallet 14, are depicted. Hence, for the corresponding features in FIGS. 3 to 5, the same reference numbers are used.

FIG. 3 shows an exploded-view drawing of a section of one of the pallets 14 depicted in FIG. 2. The pallet 14 has a partly depicted supporting body 30, which is embodied approximately in the form of a tube, and whose triangular tubular cross-section extends along a width B of the pallet 14. The supporting body 30 can be made of metal, for example aluminum, brass, steel, high-alloy chromium steel, bronze, or copper, or also of plastic, particularly glass fiber reinforced and/or carbon fiber reinforced composite materials. In order to reduce its weight, the supporting body 30 has a plurality of apertures 32, 33. The aperture 33 extends over the entire width of the supporting body 30. As a result of the triangular cross-section, in the supporting body 30 a base 31 is present, onto which at least one tread-element 40 can be fastened.

On their tread-surface 41, the tread-elements 40 of steps and pallets 14 have a tread-pattern in the form of a series of parallel ribs 49, which run from the front-side to the back-side of the tread-element 40. The ribs 49, or ridges 49, extend in the foreseen direction of movement X (forwards and backwards) of the step or pallet 14. In their planar extent, each of the tread-elements 40 is bounded by two parallel end-faces 45, 46, which extend in the foreseen direction of movement X of the step or pallet 14, and two side-edges 47, 48, which are arranged perpendicular to the end-faces 45, 46. For greater clarity, the end-faces 45, 46 and the side-edges 47, 48 are only provided with reference numbers on one of the tread-elements 40.

In most cases, with regard to the embodiment of its treadable surface, a tread-element 40 has different zones. The greater part of the treadable surface of the tread-elements 40 is provided with the ribs 49. However, depending on the embodiment of the pallets 14, the two end-face ends of a pallet 14 can also in each case have a narrow edge-section 51 without ribs 49. If the treadable surface of a pallet 14 has such edge-sections 51, the tread-elements 40 can be differently embodied. For example, tread-elements 40 with molded-on edge-sections 51 and tread-elements 40 without edge-sections 51 can be combined with each other.

Each of the tread-elements 40 has, in each case, six fastening protrusions 43 which are embodied on an underside 42 of the tread-element 40. The fastening protrusion 43 can have, for example, a conical, a truncated conical, a cylindrical or a cuboid basic shape. When the tread-element 40 is mounted on the base 31 of the supporting body 30, the fastening protrusions 43 protrude through openings 34 of the base. Each of the fastening protrusions 43 has a slot 44. The position of the slot 44 on the fastening protrusion 43 is adapted to the thickness of the material of the supporting body 30 so that, with the tread element 40 mounted on the base 31, on the side 35 of the base that faces away from the tread-element 40, the fastening protrusion 43 and its slot 44 at least partly protrude from the assigned opening 34.

Depicted below the supporting body 30 is a fixing element 60. In the assembled state, the fixing element 60, as shown in FIG. 5, is arranged inside the supporting body 30, resting against the facing-away side 35 of the base 31. In the present exemplary embodiment, the fixing element 60 has exactly the same number of assembly openings 61 as the number of fastening protrusions 43 of all tread-elements 40 of a pallet 14 together.

Each of assembly openings 61 contains an insertion area 62 and a fixing area 63. The cross-section of the insertion area 62 correlates with the cross-section of the fastening protrusion 43, so that the fastening protrusion 43, in the direction of its longitudinal extent, can be pushed through the insertion area 62. The cross-section of the fixing area 63 correlates with the reduced cross-section of the fastening protrusion 43 around the slot 44. The slots 44 of the fastening protrusions 43 are aligned in such manner that the fixing element 60 can be pushed parallel to the planar extent of the tread-element 40, or to the facing-away side 35 of the base 31, in the foreseen displacement direction V. After the insertion of the fixing element 60, through its subsequent displacement, the fixing areas 63 enter into engagement with the fastening protrusions 43 and hence areas of the fixing element 60 enter between the base 31 and the fastening protrusions 43.

Further embodied in the base 31 is a positioning opening 36 with a circular aperture cross-section. Into this positioning opening 36, a positioning lug 53, which is arranged on the tread-element 40, fits with accurate fit.

FIG. 4 shows in three-dimensional, enlarged depiction a section of the fixing element 60 which is depicted in FIG. 3 with a selection of possible embodiments of assembly openings 61. In order to differentiate the various embodiments of assembly openings 61 from each other, their reference numbers are supplemented with letters.

The first embodiment of an assembly opening 61A has only one insertion area 62A and one fixing area 63A. Without further means, this assembly opening 61A is not able to pretension the tread-element 40 against the base 31 of the supporting body 30. If the fixing element 60 has only assembly openings 61A of this first embodiment, at least one further element must be present which generates the pretension force. In order to generate the pretension, the fixing element 60 has, for example, a spring-catch 65, which protrudes towards the facing-away side 35 of the base 31 and, after assembly, presses the fixing element 60 away from the facing-away side 35 of the base 31. Thereby, in the assembled state, the fixing areas 63A which rest in the slots 44 pull against the fastening protrusions 43 and hence pull the tread-element 40 against the base 31.

The second embodiment of an assembly opening 61B has, in the fixing area 63B, a rigid wedge-tongue 64B. Upon displacement of the fixing element 60 in the foreseen assembly direction V, the rigid wedge-tongue 64B engages with a contour of the slot 44 and pulls the tread-element 40 against the base 31. Hence, with the use of rigid wedge-tongues 64B, no spring element, as, for example, the embodiment of a spring-catch 65, is required. Such a spring-catch can, however, nonetheless be embodied on the fixing element and serve as catch 65 when, for example, the base 31 has a suitable engagement aperture. In view of the manufacturing-related tolerances it is, however, probable that, after assembly, not all fastening protrusions 43 are stressed with the same pretension force, although through the driving, or hammering, of the rigid wedge-tongues 64B into the slots 44, the material of the fastening protrusion 43 is slightly deformed. Depending on the slope, or wedge-angle, of the rigid wedge-tongue 64B, on account of the frictional conditions, in the assembled state the fixing element 60 can be embodied in self-securing manner.

The third embodiment of an assembly opening 61C has not a rigid, but an elastic, wedge-tongue 64C. The elastic wedge-tongue 64C is also arranged in the fixing area 63C and can, for example as depicted, be created by bending upwards along a bending line 66C arranged diagonally at an angle $\alpha$ to the longitudinal extent of the fixing element 60. The elastic wedge-tongue 64C has the advantage that it can adapt to the different installation conditions between a fitting contour of the fastening protrusion 43 which is created by the slot 44 as a result of the manufacturing process and the side 35 which faces away from the base 31, when the fixing element 60 is displaced and the fastening protrusion 43 moves from the insertion area 62C into the fixing area 63C. If each assembly opening 61 of a fixing element 60 has at least one elastic wedge-tongue 64C, then all fastening protrusions 43 of a pallet 14 which are therewith secured are stressed with approximately the same pretension force and hence the tread-element 40, over its planar extent, is uniformly fixed in pretensioned manner against the base 31 of the supporting body 30 as is depicted in FIG. 5.

The fourth embodiment of an assembly opening 61D has an elastic, or sprung, wedge-tongue 64D as in the previously described embodiment. This elastic wedge-tongue 64D is further provided with a catch 67D. The elastic wedge-tongue 64D with catch 67D has exactly the same functions as the elastic wedge-tongue 64C of the third embodiment. However, as soon as, upon displacement of the fixing element 60 in assembly direction V, the fixing area 63D is arranged far enough in the slot 44 of the fastening protrusion 43, so that the catch 67D leaves the slot 44 again, the elastic wedge-tongue 64D with the catch 67D springs back. If, now, the fixing element 60 is pushed back in the direction opposite to assembly direction V, the catch 64D rests with mechanical engagement against the fastening protrusion 43 and prevents a further pushing-back of the fixing element 60.

Self-evidently, a fixing element 60 can have all embodiments of assembly breakouts 61A, 61B, 61C, 61D. Preferably, however, in one fixing element 60, all assembly openings 61 are embodied as identical, or at most two different, embodiments.

FIG. 5 shows in three-dimensional depiction a partial underside view of the pallet 14 depicted in FIG. 3 with tread-element 40 already mounted and fixing element 60 already inserted. Clearly visible in FIG. 5 is how the sprung wedge-tongue 64C of an assembly opening 61C of the third embodiment engages in the slot 44 of the fastening protrusion 43 and thereby fixes the tread-element 40 at this point against the base 31 in pretensioned manner. In order to better show the position of the wedge-tongue 64C, the fixing element 60 is not yet completely inserted in the assembly direction V, so that a part of the fixing area 63C is still visible.

Figure 6:
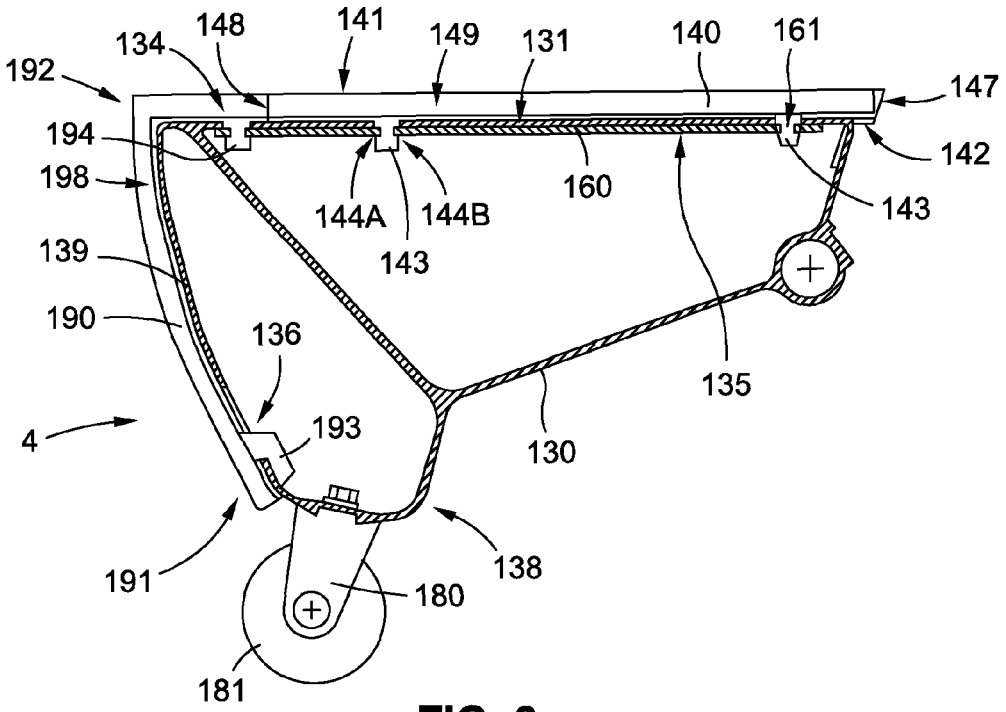
FIG. 6: in cutaway depiction, a side-view of a step of an escalator which has a tube-shaped step body.

As depicted in FIG. 6, the elements described above can also be used for assembly of steps 4 of escalators 1. FIG. 6 shows in a cutaway side-view depiction a step 4 with a tube-shaped supporting body 130, which latter also has a base 131. The supporting body 130 is made, for example, from an extruded aluminum section. Arranged on the underside 138 of the supporting body 130 is a step-roller holding fixture 180 for the purpose of accommodating a step-roller 181. Also arranged on the step 4 with their underside 142 resting on the base 131 of the supporting body 130 are tread-elements 140 which are bounded by end-faces and side-edges 147, 148 which extend in the direction of the width. In analogous manner to the previously described pallet, these are fastened onto the supporting body 130, a series of fastening protrusions 143 being visible in the cutout depiction. Different from the fastening protrusions 43 that are depicted in FIGS. 3 to 5, the fastening protrusions 143 which are depicted in FIG. 6 have two slots 144A, 144B, which are arranged on oppositely-facing sides of the fastening protrusion 143. The fixing element 160 therefore has assembly openings 161 whose fixing areas engage in both apertures 144A, 144B of a fastening protrusion 143.

The step 4 further has a riser-element 190 which has lower hook-lugs 193 and upper fastening protrusions 194 which are arranged in the edge-areas 191, 192 which extend across the width. The upper fastening protrusions 194 which are arranged in the area of the base 131 are embodied like the fastening protrusions 143 of the tread-element 140 and protrude into the openings 134 that are embodied in the base. The hook-lugs 193 which are arranged near to the step-roller holding fixture 180 protrude into lower assembly openings 136 and hook under a front wall 139 of the supporting body 130. The securing of the riser-element 190 by means of the fixing element 160 takes place in analogous manner to the securing of the tread-element 140. During assembly, the riser element 190 and the tread-element 140 can first be mounted onto the supporting body 130. Then, by pushing or driving the fixing element 160 onto the side 135 of the base 131 that faces away from the tread-element 140, the tread-element 140 and the riser-element 190 are fixed in pretensioned manner onto the supporting body 130. Self-evidently, the riser-element 190 can also be tightly fastened to the supporting body 130 by welding, soldering, riveting, clinching, bonding, or by screw-fastenings. The riser-element 190 also has ribs 198, which adjoin the ribs 149 that are arranged on the tread-surface 141 of the tread-element 140.

Although the invention has been described by the depiction of specific exemplary embodiments, it is self-evident that, with knowledge of the present invention, numerous further variant embodiments can be created, for example, in that, on pallets or steps, instead of a tube-shaped supporting body, pallet- or step-skeletons can be used, as are disclosed, for example, in U.S. Pat. No. 8,322,508 B2. The tube-shaped supporting body can further have a cross-section which deviates from the trapezoidal or triangular cross-sectional form, in that, for example, by means of further folds, a polygonal cross-sectional form is created. Self-evidently, one or more tread-elements with the fastening concept according to the invention can also be used in a step with a step-skeleton. In addition, the tread-elements need not necessarily be a cast-aluminum part. The tread-elements can also be cut out from a blank or, by means of a die, manufactured as a forged part. Self-evidently, the tread-elements can also consist of sheet-metal parts, in particular deep-drawn sheet-metal parts. Furthermore, the tread-elements can be of a glass fiber reinforced and/or carbon fiber reinforced plastic, or of another composite material. Further, the tread-elements can be at least partly manufactured from a natural stone such as granite or marble, or from an amorphous material such as glass.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A step of an escalator or a pallet of a moving walk comprising:

a supporting body with a base;

a fixing element; and a tread-element with a tread-surface, wherein the tread-element has a fastening protrusion on an underside facing away from the tread-surface and protruding through an opening in the base, the fastening protrusion having a slot that extends parallel to the tread-surface and into which slot the fixing element is at least partly inserted, wherein the fixing element is arranged at least partly between the base and the tread-element and the tread-element is fixed by the fixing element against the base with a pretension force.

2. The step or the pallet according to claim 1 wherein the fastening protrusion extends perpendicular to the tread-surface.

3. The step or the pallet according to claim 1 wherein the tread-element extends in a plane bounded by two parallel end-faces that extend in an intended direction of movement of the step or the pallet in use and by two side-edges arranged perpendicular to the end-faces.

4. The step or the pallet according to claim 1 wherein the fixing element is displaceable parallel to the base.

5. The step or the pallet according to claim 1 including another tread-element having another fastening protrusion protruding through another opening in the base and fixed by the fixing element against the base with another pretension force.

6. The step or the pallet according to claim 1 wherein the fixing element includes a catch engaging the base or the fastening protrusion.

7. The step or the pallet according to claim 1 wherein the tread-element includes a positioning lug that protrudes into a positioning opening of the base.

8. The step or the pallet according to claim 1 wherein the fixing-element has a wedge-tongue for generating the pretension force.

9. The step or the pallet according to claim 8 wherein the wedge-tongue is elastic.

10. The step or the pallet according to claim 1 wherein the supporting body is tubular in cross-section.

11. The step or the pallet according to claim 10 wherein the supporting body is triangular cross-section.

12. A pallet-band of a moving walk comprising at least one traction means and with a plurality of the pallet according to claim 1 arranged on the at least one traction means.

13. A moving walk with the pallet-band according to claim 12 arranged to circulate.

14. A step-band of an escalator comprising at least one traction means and with a plurality of the step according to claim 1 arranged on the at least one traction means.

15. An escalator with the step-band according to claim 14 arranged to circulate.

16. A method for modernization of a moving walk comprising the steps of:

providing a new pallet-band having at least one traction means and with a plurality of pallets arranged thereon, each of the pallets including a supporting body with a base, a fixing element, and a tread-element with a tread-surface, wherein the tread-element has a fastening protrusion on an underside facing away from the tread-surface and protruding through an opening in the base, the fastening protrusion having a slot that extends parallel to the tread-surface and into which slot the fixing element is at least partly inserted, wherein the fixing element is arranged at least partly between the base and the tread-element and the tread-element is fixed by the fixing element against the base with a pretension force; and replacing an existing pallet-band of the moving walk with the new pallet-band.

17. A method for modernization of an escalator comprising the steps of:

providing a new step-band having at least one traction means and with a plurality of steps arranged thereon, each of the steps including a supporting body with a base, a fixing element, and a tread-element with a tread-surface, wherein the tread-element has a fastening protrusion on an underside facing away from the tread-surface and protruding through an opening in the base, the fastening protrusion having a slot that extends parallel to the tread-surface and into which slot the fixing element is at least partly inserted, wherein the fixing element is arranged at least partly between the base and the tread-element and the tread-element is fixed by the fixing element against the base with a pretension force; and replacing an existing step-band of the escalator with the new step-band.

* * * * *